US009984600B1

(12) United States Patent
Daly

(10) Patent No.: US 9,984,600 B1
(45) Date of Patent: May 29, 2018

(54) ADVERTISING SIGN BRACKET

(71) Applicant: Dan Daly, Brentwood, NH (US)

(72) Inventor: Dan Daly, Brentwood, NH (US)

( * ) Notice: Subject to any disclaimer, the term of this patent is extended or adjusted under 35 U.S.C. 154(b) by 0 days. days.

(21) Appl. No.: 15/271,500

(22) Filed: Sep. 21, 2016

Related U.S. Application Data

(60) Provisional application No. 62/221,808, filed on Sep. 22, 2015.

(51) Int. Cl.
*G09F 7/22* (2006.01)
*G09F 7/00* (2006.01)
*G09F 7/18* (2006.01)

(52) U.S. Cl.
CPC ..... *G09F 7/22* (2013.01); *G09F 7/002* (2013.01); *G09F 2007/1834* (2013.01)

(58) Field of Classification Search
CPC ..... G09F 7/22; G09F 2007/1834
See application file for complete search history.

(56) References Cited

U.S. PATENT DOCUMENTS 664,049 A * 12/1900 Johnson ..... G09F 7/22 160/351
688,200 A * 12/1901 Schwab ..... G09F 7/22 40/493
1,361,911 A * 12/1920 Schwesinger, Jr. . G09F 15/0087 40/602
1,750,118 A * 3/1930 Mueller, Jr. ..... G09F 7/22 248/170
1,824,444 A * 9/1931 Mueller, Jr. ..... G09F 1/14 248/166
1,845,590 A * 2/1932 Edwards ..... G09F 7/22 248/166
1,856,349 A * 5/1932 Bigelow ..... E01F 9/688 116/63 P
1,889,910 A * 12/1932 Weamer ..... G09F 7/22 40/624
2,054,230 A * 9/1936 Patterson ..... G09F 7/22 40/613
2,467,187 A * 4/1949 Capper ..... G09F 7/22 40/613
2,533,778 A * 12/1950 Eckhardt ..... A47G 1/14 40/606.15
2,841,902 A * 7/1958 Pfundt ..... A47G 1/24 40/602
4,214,393 A * 7/1980 Long ..... G09F 7/20 40/613
4,248,001 A * 2/1981 Feuvray ..... E01F 9/688 40/602
4,280,294 A * 7/1981 Eckberg, II ..... G09F 7/18 40/606.15
4,365,435 A * 12/1982 Snyder, Jr. ..... G09F 7/22 40/602
4,879,965 A * 11/1989 Valley ..... G09F 7/22 116/209

(Continued)

*Primary Examiner* — Gary C Hoge
(74) *Attorney, Agent, or Firm* — Luis Figarella

(57) ABSTRACT

An advertising sign bracket that allows quick and simple replacement of a display panel while at the same time preventing damage to both the display panel as well as the complete advertising structure from strong winds. The free swinging provided by the bracket allows for a blow-through pivotal sign attached to a support structure to rotate along a horizontal axis, without the vertical display panel leaving the assembly while swinging freely.

17 Claims, 18 Drawing Sheets

(56) References Cited

U.S. PATENT DOCUMENTS

| | | | | |
|---|---|---|---|---|
| 4,912,865 | A * | 4/1990 | Ellsworth | G09F 7/22 40/602 |
| 2016/0117960 | A1 * | 4/2016 | Dalton | G09F 7/22 248/595 |

* cited by examiner

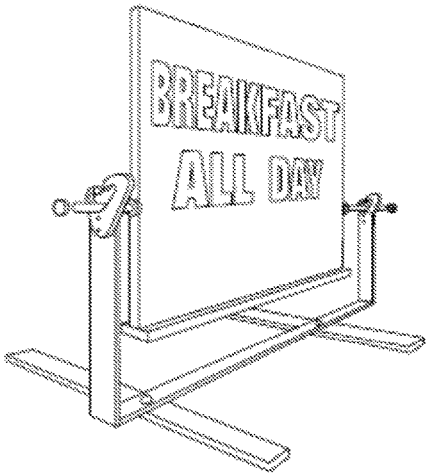
Figure 21
Figure 22
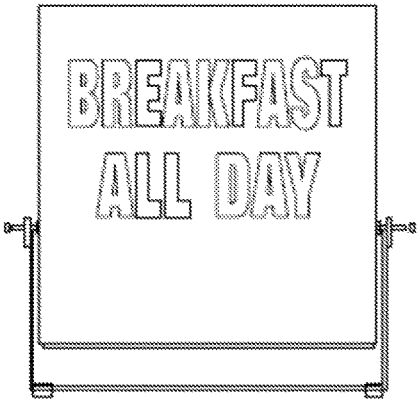
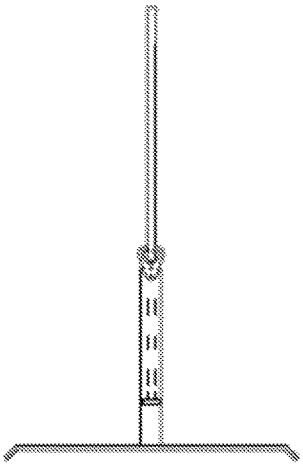
Figure 23

ADVERTISING SIGN BRACKET

CROSS-REFERENCE TO RELATED APPLICATIONS

This application claims priority to U.S. Provisional patent application Ser. No. 62/221,808 titled "Advertising Sign" filed on Sep. 22, 2015 the disclosure of which is herein incorporated by reference in its entirety.

PATENTS CITED

The following documents and references are incorporated by reference in their entirety, Capper (U.S. Pat. No. 2,467,187), Mueller Jr. et al (U.S. Pat. No. 1,750,118), Sarkisian (U.S. Pat. No. 3,646,696), Raymond (U.S. Pat. No. 900,590), Hallowell et al (U.S. Pat. No. 1,858,152), Long (U.S. Pat. No. 4,214,393) and Holcomb (U.S. Pat. No. 2,872,750).

FIELD OF THE INVENTION

The present invention relates generally to a sign mounting system, and specifically to a bracket that allows quick and simple replacement of one or more display panels while at the same time preventing damage to the complete advertising structure from strong winds.

DESCRIPTION OF THE RELATED ART

In various types of businesses signs are used for advertising purposes related to a business. Some of these are meant to be permanent, semi-permanent or temporary, in both indoor and outdoor situations. The latter two types require the ability to be removed during temporary situations (high winds, night), while allowing the owner to update the information regularly.

At times, they may require the ability to be removed to another location. An example of this is the real estate business, advertising properties for sale or for rent, and the construction business, such as road construction, where temporary signs are mounted for directing the traffic.

In one embodiment, the type of sign has the continual problem of having to change the message on a regular basis, preferably by a single operator in an easy fashion.

In another embodiment, this type of sign has the continual problem of preventing overturning through wind forces. Even with enlarged bases there has been no assurance against overturning.

What is needed, is a bracket system that would allow a temporary sign that will resist the embattlements of the weather, allow quick and easy access to changing its message, while remaining light-weight and portable.

SUMMARY OF THE INVENTION

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

In one aspect, the invention is about a portable sign apparatus comprising two or more pin cradles, one or more display panel support frame(s), each said support frame having one or more said pin cradles on said support frame end, a display panel assembly, a pin assembly comprised of one or more rods whose ends form pins that extend from said display panel assembly, wherein each said pin end goes through a pin cradle opening; and wherein one or more of said pin cradle openings has a gap formed along the top, said gap having a span equal or larger than the diameter of the pin going into said pin cradle. In another aspect, said pin assembly is comprised of one or more pins extending from two or more sides of said display panel assembly. In yet another aspect, said display panel assembly is comprised of a display panel. In another aspect, one or more of said pin cradle gap edges have a pin trapping protrusion formed along at least one side of said gap edge. In another aspect, said display panel has a weight at or near said panel's bottom; and said display panel support frames are supported by one or more legs. In another aspect, said display panel has a weight at or near said panel's bottom; and said display panel support frames are supported by one or more legs. In yet another aspect, a sign as described above is comprised of a sign frame.

In another aspect, the invention is about a portable table sign apparatus comprising a support assembly comprised of support legs and pin cradles, a sheet material display panel, said display panel including a weighted base and two or more support pins extending horizontally past said frame and through said support assembly pin cradles, wherein each said pin cradle comprises a void in said support leg with an opening directly above said pin cradle's bottom, said opening being just wide enough to permit easy insertion of said pin into said pin cradle, and said void being substantially wider and deeper than said pin; and wherein the cross-section of said pins can have any shape, as long as said pins' smallest dimension is smaller than the opening at the top of said pin cradles.

Other features and advantages of the present invention will become apparent upon examining the following detailed description of an embodiment thereof, taken in conjunction with the attached drawings.

BRIEF DESCRIPTION OF THE DRAWINGS

FIG. 21 shows an isometric view of a separate/removable pin cradle sign with a sign frame, according to an exemplary embodiment of the invention.

FIG. 22 shows a front view of a separate/removable pin cradle sign with a sign frame, according to an exemplary embodiment of the invention.

FIG. 23 shows a side view of a separate/removable pin cradle sign with a sign frame, according to an exemplary embodiment of the invention.

Figure 1:
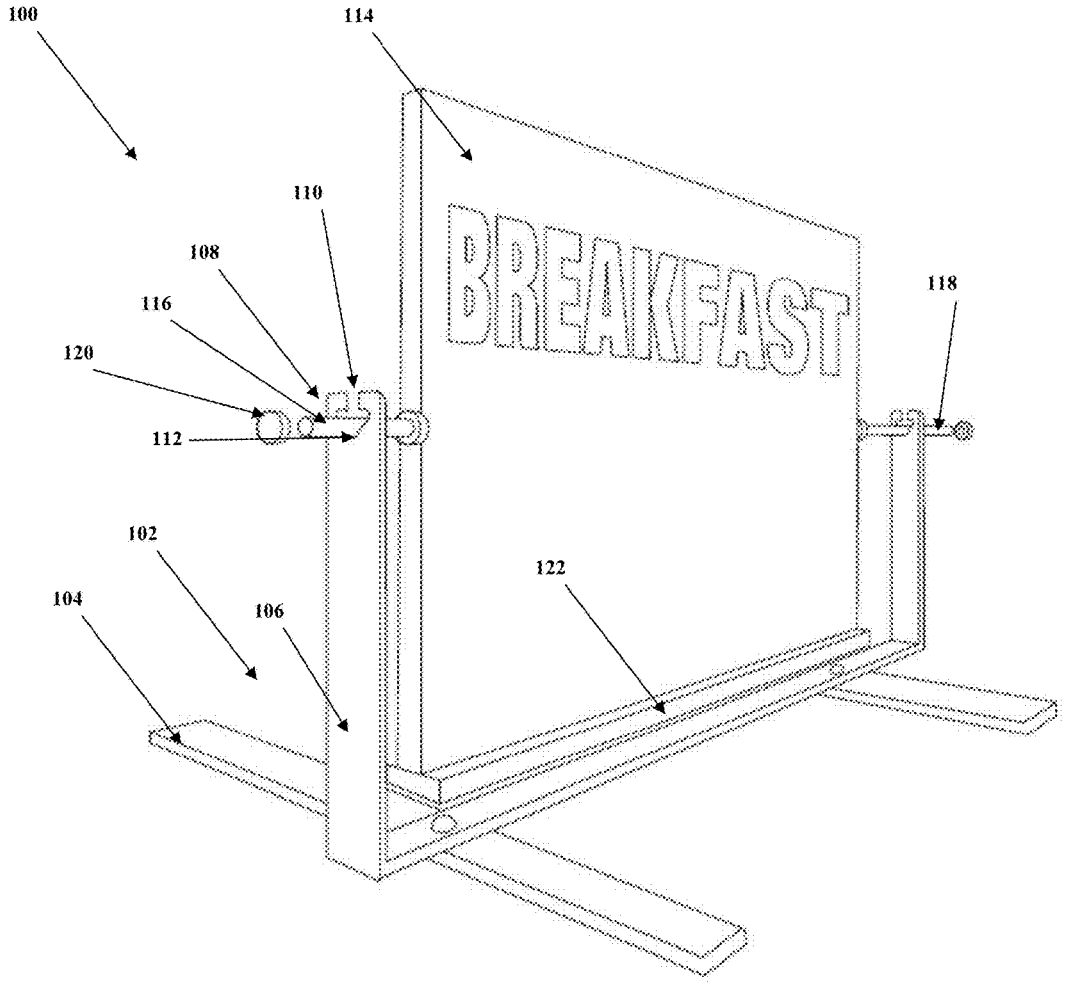
FIG. 1 shows an overall illustration of the brackets, sign and other components, according to an exemplary embodiment of the invention.

The above-described and other features will be appreciated and understood by those skilled in the art from the following detailed description, drawings, and appended claims.

DETAILED DESCRIPTION OF THE PREFERRED EMBODIMENT

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

To provide an overall understanding of the invention, certain illustrative embodiments and examples will now be described. However, it will be understood by one of ordinary skill in the art that the same or equivalent functions and sequences may be accomplished by different embodiments that are also intended to be encompassed within the spirit and scope of the disclosure. The compositions, apparatuses, systems and/or methods described herein may be adapted and modified as is appropriate for the application being addressed and that those described herein may be employed in other suitable applications, and that such other additions and modifications will not depart from the scope hereof.

Simplifications or omissions may be made to avoid obscuring the purpose of the section. Such simplifications or omissions are not intended to limit the scope of the present invention. All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art.

As used in the specification and claims, the singular forms "a", "an" and "the" include plural references unless the context clearly dictates otherwise. For example, the term "a transaction" may include a plurality of transaction unless the context clearly dictates otherwise. As used in the specification and claims, singular names or types referenced include variations within the family of said name unless the context clearly dictates otherwise.

Certain terminology is used in the following description for convenience only and is not limiting. The words "lower," "upper," "bottom," "top," "front," "back," "left," "right" and "sides" designate directions in the drawings to which reference is made, but are not limiting with respect to the orientation in which the modules or any assembly of them may be used.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

Referring to FIG. 1 we see an isometric view of an exemplary embodiment of the proposed advertising sign system. One embodiment 100 illustrates an exemplary support assembly 102 comprised of one or more leg assemblies 104 supporting a display panel support frame 106.

The leg assemblies 104 may be comprised of straight legs or spans, as well as any suitable assembly which supports the sign assembly on the ground. These include ground poles or suitable single grounding assemblies (including those having some form of spring), as well as the A-frame 900 shown.

The display panel support frame 106 spans the width of the sign, having at or near its end, one or more pin cradles 108 formed by a pin cradle opening 112. Said pin cradles openings 112 may be closed 1200, or may have a gap 112 at its apex or upper area, above said pin cradle's bottom 112. Wind pressure on the display panel forces the pin sideways within said void and prevents said pin from moving outward or upward. Said pins can be inserted and extracted from the cradle by lifting the display panel straight up through the cradle opening without the need of fasteners or other securing mechanism.

Each sign requires to said pin cradles 108, and these may be formed anywhere along the length of the support frame, not just at the ends. In addition, the cradles may be separate/removable members that are attached along the frames through suitable mechanical (snap-on, screws, welds, taps), chemical means (glue, epoxy, etc.) and/or any other suitable means.

The display panel assembly is comprised of either a standalone display panel 114, or a sign frame 1002 supporting said display panel by going around said display panel 114. Said display panel 114 may be made from any number of suitable materials. In many applications, these may include the requirement to survive wind, sun, Ultraviolet ray (UV) exposure, rain, etc, although indoor applications may be considered. The suitable materials include paper, cardboard, plastics, wood, metal (both ferrous and non-ferrous), cloth or fabric (preferably one with stretchable capabilities when using a frame 1002), all or portions of plastic or rubber (Nylon, rubber, etc.), a mixture comprised of a synthetic or semi-synthetic organic solid, typically a polymer of high molecular mass, and may contain other substances to improve performance and/or reduce costs. There are two types of plastics: thermoplastics and thermosetting polymers. Nylon is such a thermoplastic, silky material. Nylon is made of repeating units linked by amide bonds and is frequently referred to as polyamide (PA). Except for the non-rigid choices, similar choices may be used for the sign frame 1002.

In one embodiment, the pin assembly is comprised of two or more rods whose ends are pins 116, 118 that extend horizontally beyond the sides of the display panel assembly and through the pin cradles. In an alternate embodiment, the pin assembly is comprised of a single rod 402 that goes all the way across the sign (either on one side of the display panel 114 or inside it), having two ends or pins 116, 118. Optional caps 120 may be added to the ends of the pins 116, 118. In this fashion, the display panel 114 may be removed by either lifting the pins 116, 118 through the opening 110, and/or by pushing the sign to one side and swiveling it out. Note that while the pin and/or rod may be round/circular/ovoid shaped, many other cross section shapes are possible, including rectangular 3102, triangular, square, etc. A rectangular pin may allow for better protection 3002 while allowing for a thinner gap opening as it makes the extraction of the sign from the pin cradle only possible when the sign is in a specific position under a straight up force, almost always only possible to human hands, not wind forces.

At its bottom, the display panel 114 or sign frame has an optional weight 122 to assist it in resisting the wind as the display panel swivels on the pin cradles in response to wind or user's induced motions. In an optional embodiment 1302, the weigh may be avoided if the pins 116, 118, 402 are located high enough along the side of the display panel 114 or sign frame so that the larger amount of display panel sign below the pin horizontal line allows for the larger mass below said line to keep the sign upright.

Figure 2:
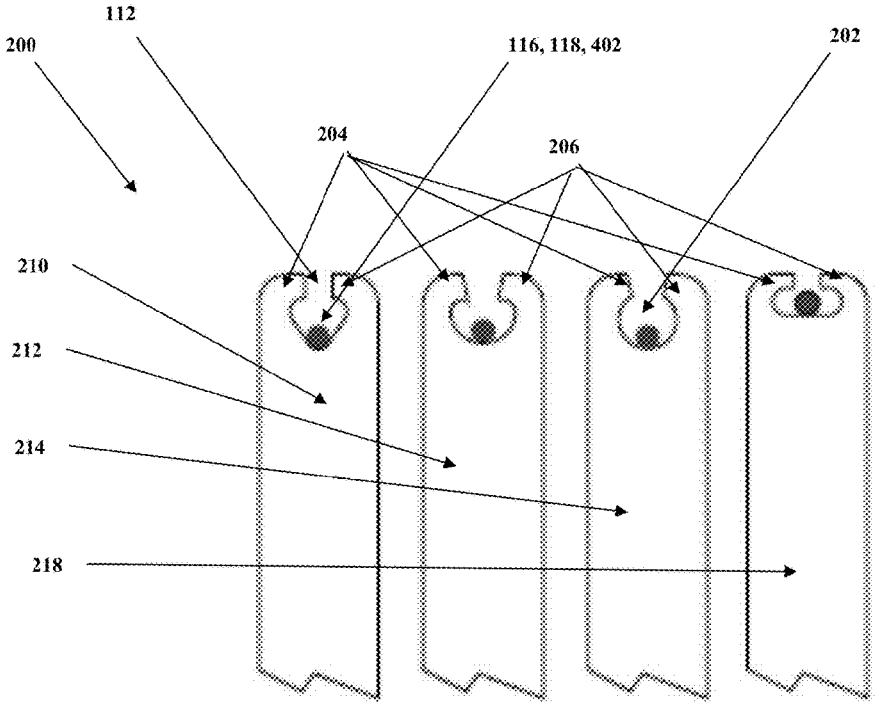
FIG. 2 shows various bracket configurations, according to exemplary embodiments of the invention.
Figure 3:
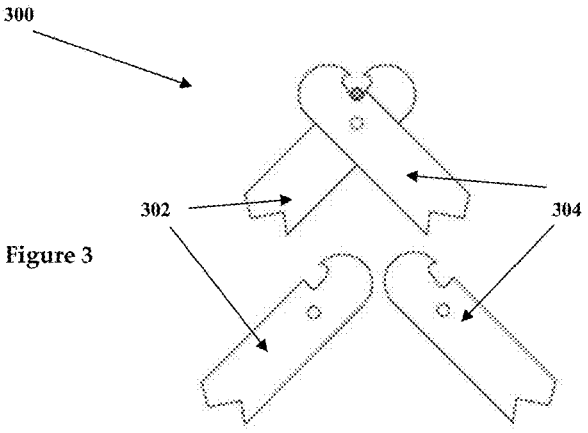
FIG. 3 shows a side view of the bracket components, according to an exemplary embodiment of the invention.
Figure 4:
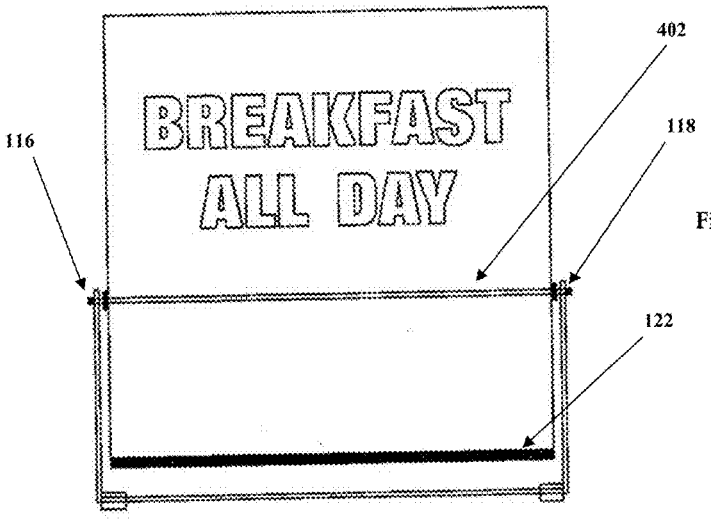
FIG. 4 shows a front view of the sign structure, according to an exemplary embodiment of the invention.
Figure 5:
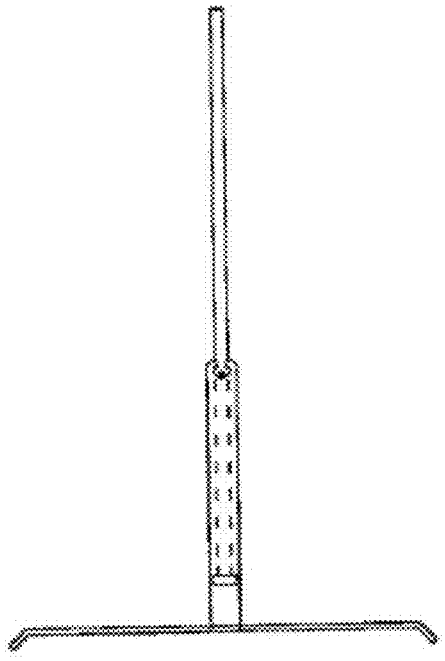
FIG. 5 shows a side view of the sign structure, according to an exemplary embodiment of the invention.
Figure 6:
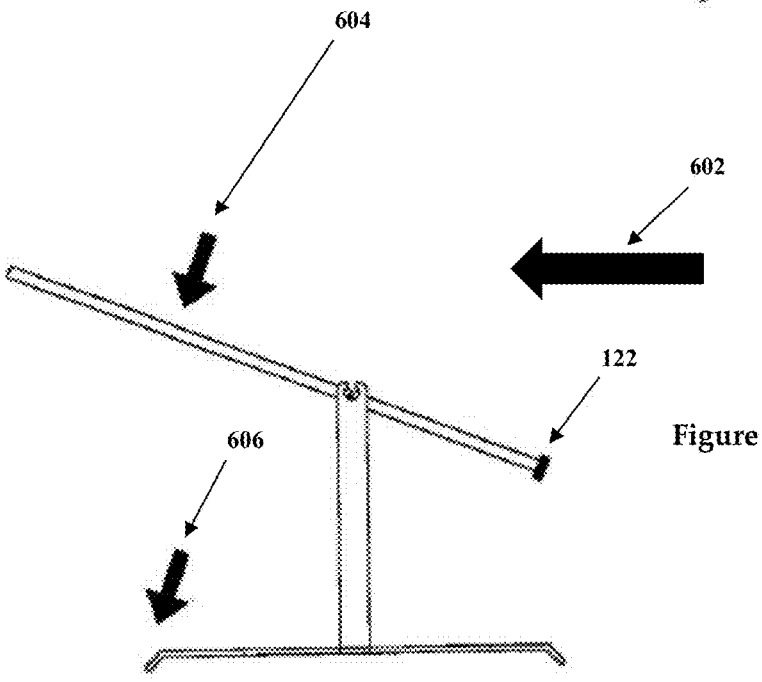
FIGS. 6-8 show side views of the sign structure when subjected to wind forces, according to an exemplary embodiment of the invention.
Figure 7:
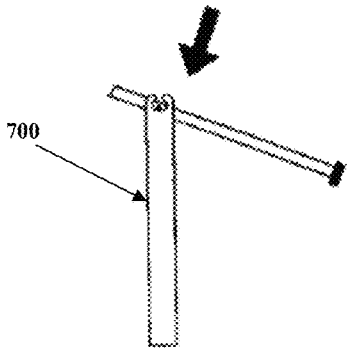
Figure 8:
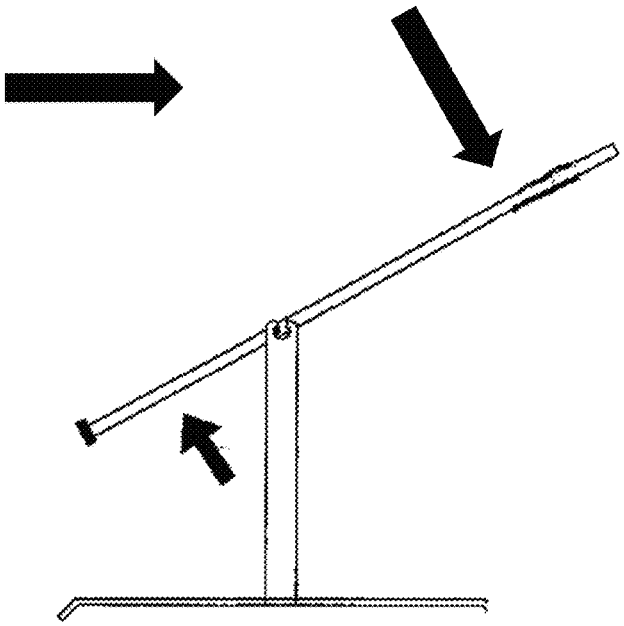
Figure 9:
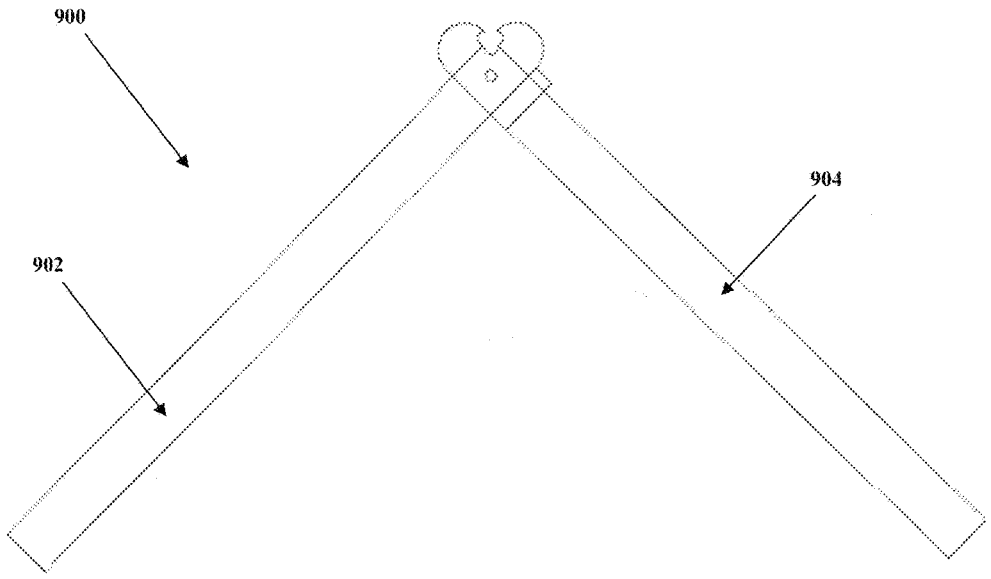
FIG. 9 shows another side view of the bracket structure, according to an exemplary embodiment of the invention.
Figure 10:
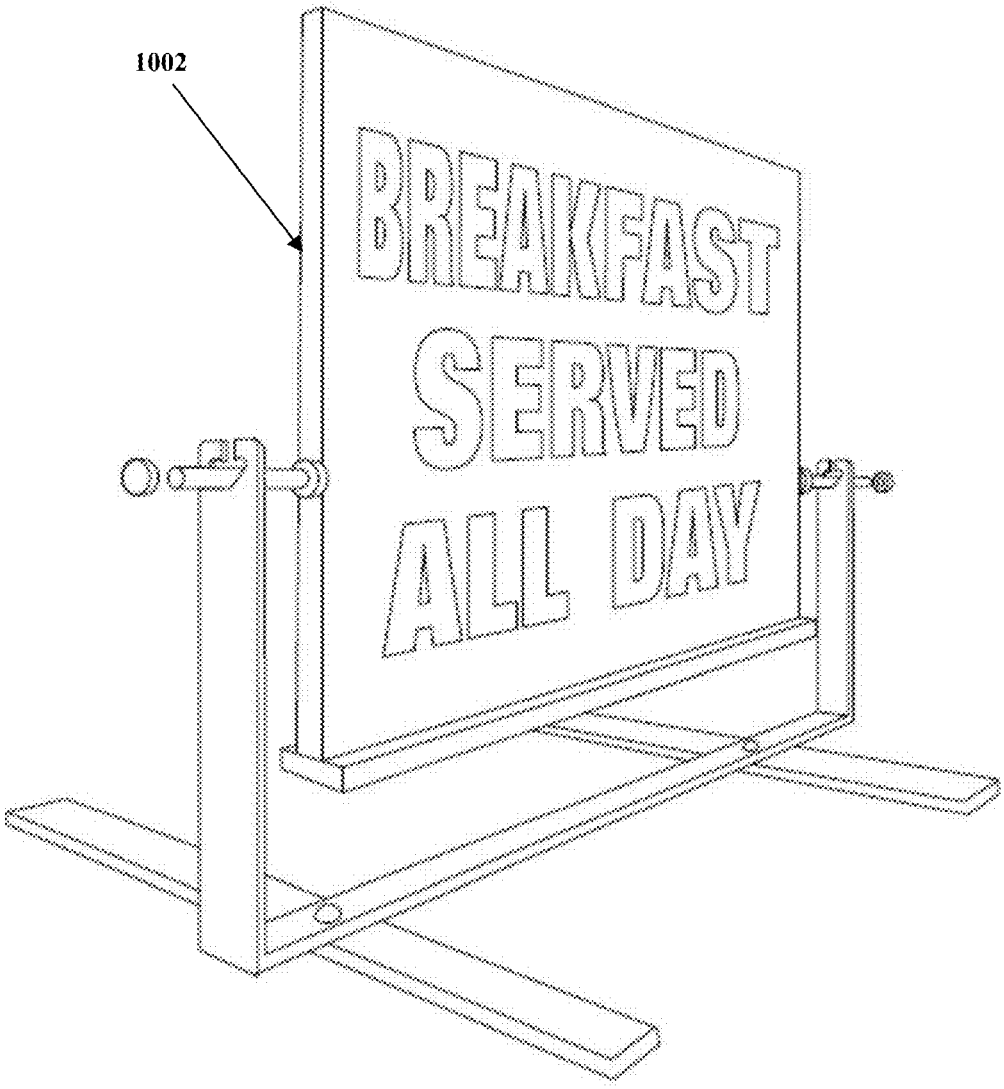
FIG. 10 shows an isometric view of the sign structure, according to an exemplary embodiment of the invention.
Figure 11:
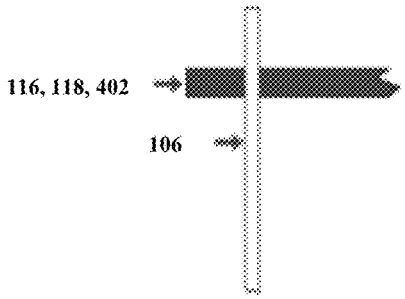
FIG. 11 shows a side view of the bracket structure, according to an exemplary embodiment of the invention.
Figure 12:
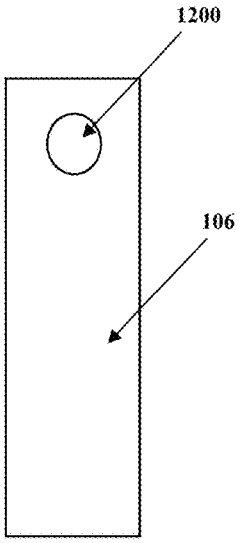
FIG. 12 shows a side view of the closed pin cradle structure, according to an exemplary embodiment of the invention.
Figure 13:
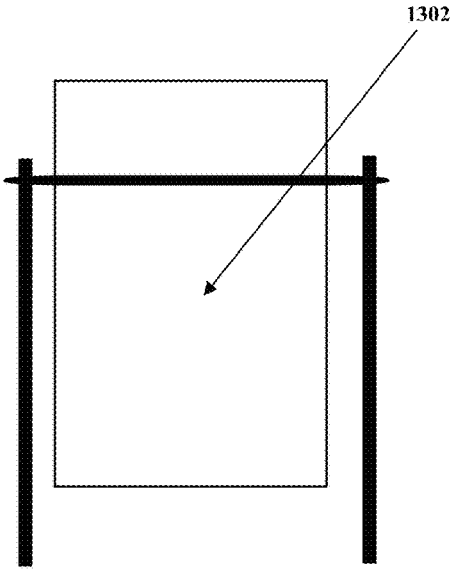
FIG. 13 shows a front view of the sign structure without a weight, according to an exemplary embodiment of the invention.
Figure 14:
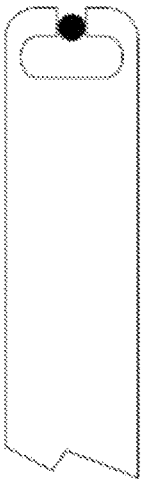
FIG. 14 shows a side view of the pin within the pin cradle, according to an exemplary embodiment of the invention.
Figure 15:
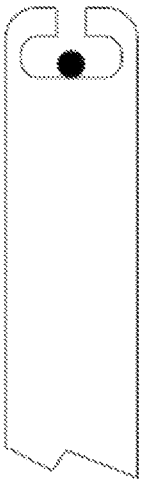
FIG. 15 shows a side view of the pin within the pin cradle, according to an exemplary embodiment of the invention.
Figure 16:
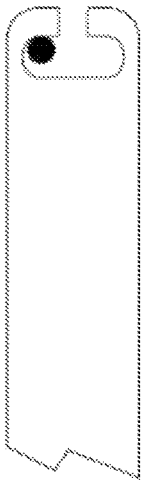
FIG. 16 shows a side view of the pin within the pin cradle, according to an exemplary embodiment of the invention.
Figure 17:
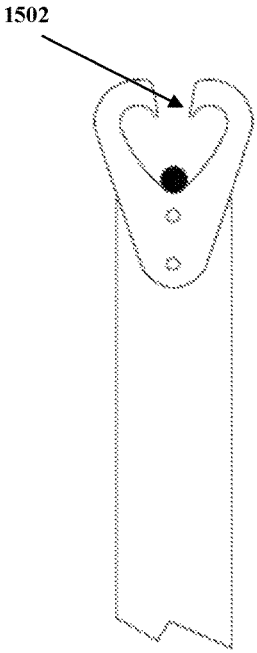
FIG. 17 shows a side view of a separate/removable pin cradle during a specific pin location, according to an exemplary embodiment of the invention.
Figure 18:
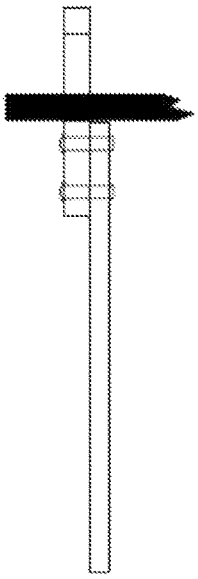
FIG. 18 shows various side views of a separate/removable pin cradle during a specific pin location, according to an exemplary embodiment of the invention.
Figure 19:
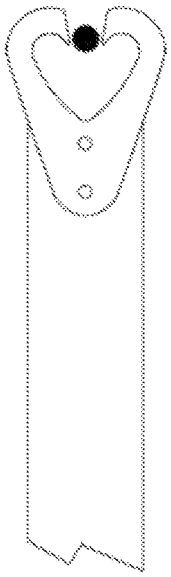
FIG. 19 shows various side views of a separate/removable pin cradle during a specific pin location, according to an exemplary embodiment of the invention.
Figure 20:
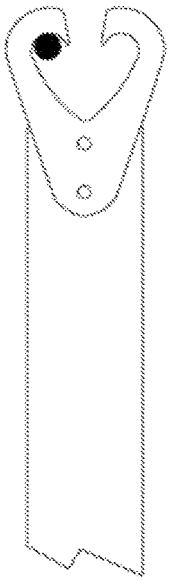
FIG. 20 shows various side views of a separate/removable pin cradle during a specific pin location, according to an exemplary embodiment of the invention.
Figure 24:
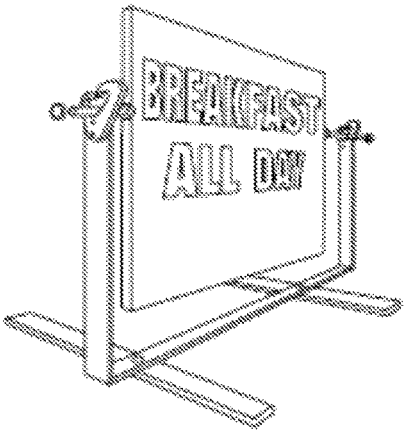
FIG. 24 shows an isometric view of a separate/removable pin cradle sign without a sign frame and using the weight of the sign as the weight to keep the sign straight, according to an exemplary embodiment of the invention.
Figure 25:
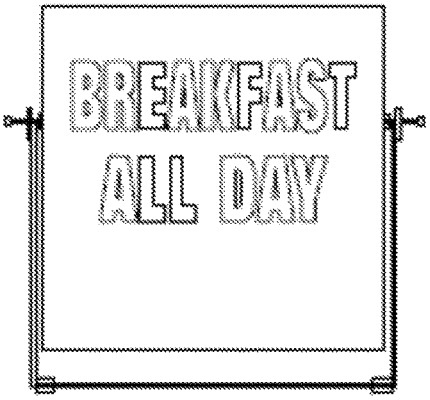
FIG. 25 shows a front view of a separate/removable pin cradle sign without a sign frame and using the weight of the sign as the weight to keep the sign straight, according to an exemplary embodiment of the invention.
Figure 26:
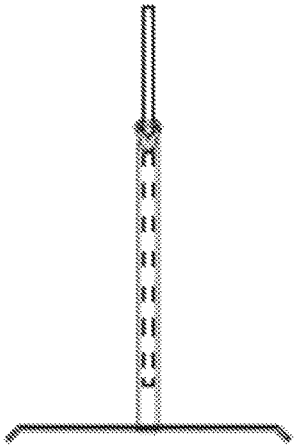
FIG. 26 shows a side view of a separate/removable pin cradle sign without a sign frame and using the weight of the sign as the weight to keep the sign straight, according to an exemplary embodiment of the invention.
Figure 27:
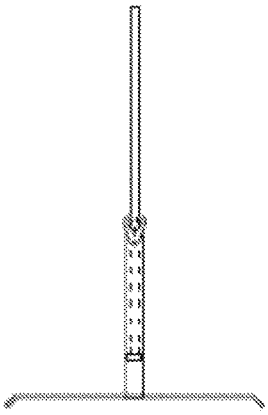
FIG. 27 shows a side view of the sign under no wind effect, according to an exemplary embodiment of the invention.
Figure 28:
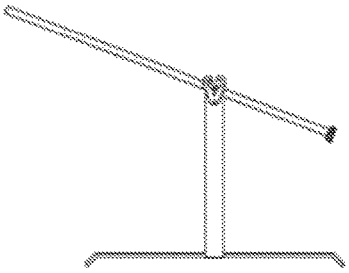
FIG. 28 shows a side view of the sign under severe wind effect, according to an exemplary embodiment of the invention.
Figure 29:
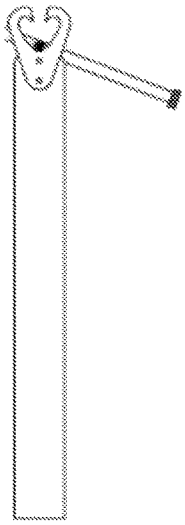
FIG. 29 shows a detailed side view of the sign under severe wind effect, according to an exemplary embodiment of the invention.
Figure 30:
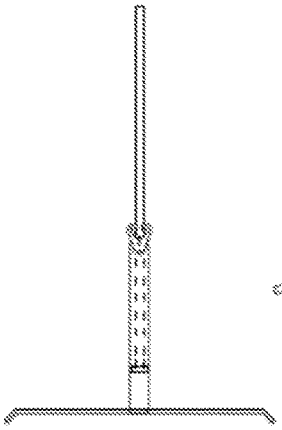
FIG. 30 shows a side view of the sign under no swinging motion, according to an exemplary embodiment of the invention
Figure 31:
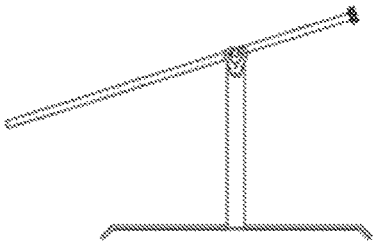
FIG. 31 shows a side view of the sign under extreme swinging motion, according to an exemplary embodiment of the invention.
Figure 32:
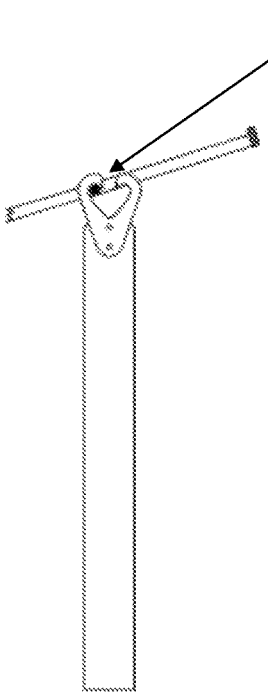
FIG. 32 shows a side views of the sign under extreme swinging motion, in particular showing how the pin protrusion holds the pin within the pin cradle, according to exemplary embodiments of the invention.
Figure 33:
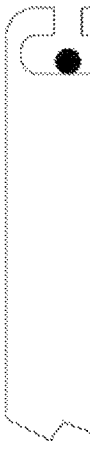
FIG. 33 shows a side view of the pin cradle with the pin in it, according to an exemplary embodiment of the invention.
Figure 34:
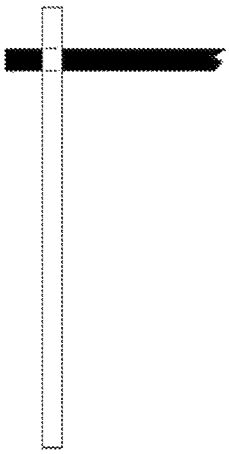
FIG. 34 shows a front view of the pin cradle with the pin in it, according to an exemplary embodiment of the invention.
Figure 35:
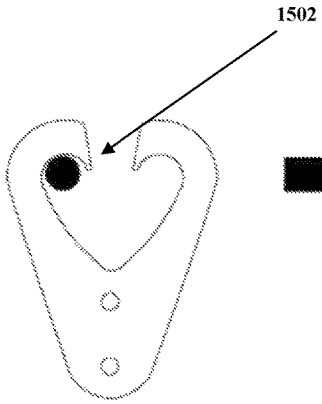
FIG. 35 shows a side view with details of the pin riding high within the pin cradle opening, and encountering the pin protrusion, thereby becoming trapped and prevented from leaving the pin cradle, according to an exemplary embodiment of the invention.
Figure 36:
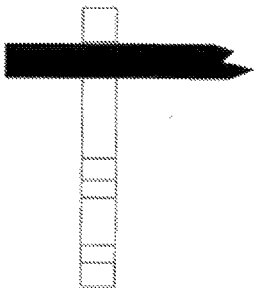
FIG. 36 shows a front view with details of the pin riding high within the pin cradle opening, and encountering the pin protrusion, thereby becoming trapped and prevented from leaving the pin cradle, according to an exemplary embodiment of the invention.
Figure 37:
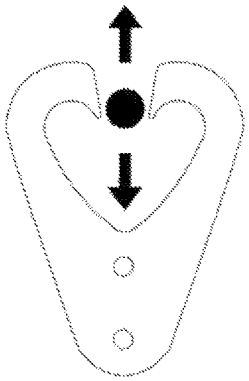
FIG. 37 shows a side view with details of the only easy way for the pin to leave the pin cradle (through the pin cradle gap), according to an exemplary embodiment of the invention.
Figure 38:
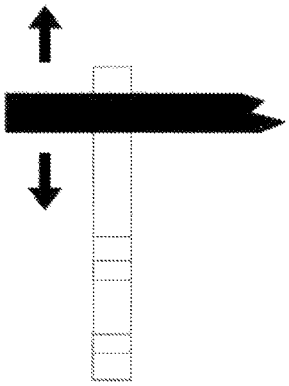
FIG. 38 shows a side view with details of the only easy way for the pin to leave the pin cradle (through the pin cradle gap), according to an exemplary embodiment of the invention.
Figure 39:
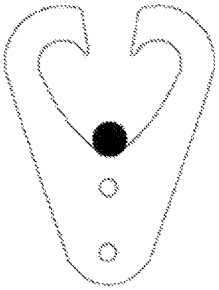
FIG. 39 shows a side view with details of the pin sitting at the bottom of the pin cradle, according to an exemplary embodiment of the invention.
Figure 40:
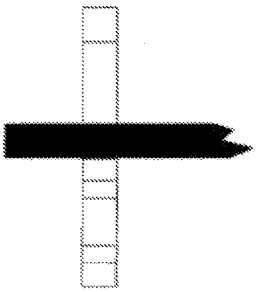
FIG. 40 shows a front view with details of the only easy way for the pin sitting at the bottom of the pin cradle, according to an exemplary embodiment of the invention.
Figure 41:
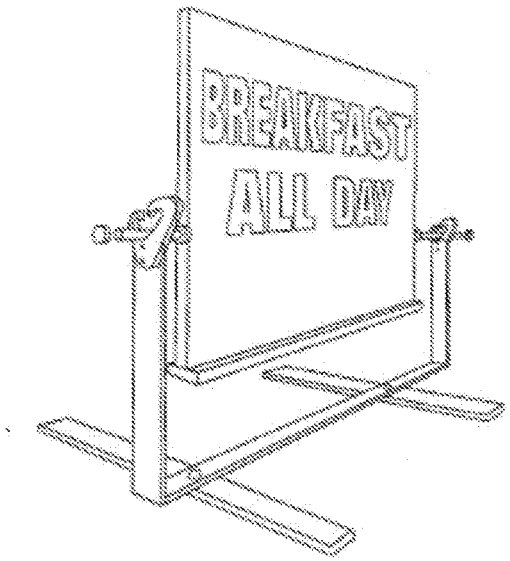
FIG. 41 shows an isometric view of a separate/removable pin cradle sign with a sign frame having a weight at the bottom, according to an exemplary embodiment of the invention.
Figure 42:
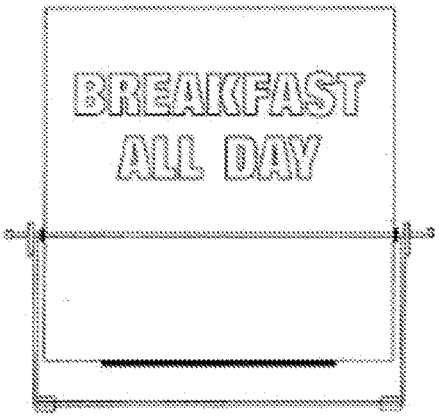
FIG. 42 shows a front view of a separate/removable pin cradle sign with a sign frame having a weight at the bottom, according to an exemplary embodiment of the invention.
Figure 43:
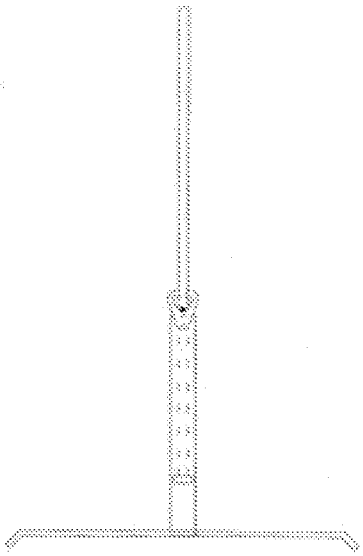
FIG. 43 shows a side view of a separate/removable pin cradle sign with a sign frame having a weight at the bottom, according to an exemplary embodiment of the invention.
Figure 44:
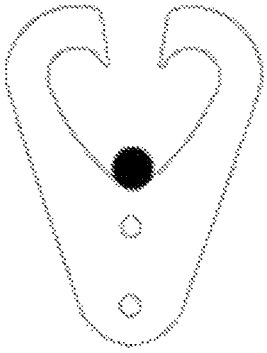
FIG. 44 shows a side view with details of the pin trapped at the top of the pin cradle, according to an exemplary embodiment of the invention.
Figure 45:
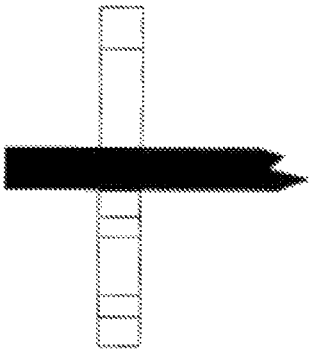
FIG. 45 shows a front view of the pin cradle, according to an exemplary embodiment of the invention.
Figure 46:
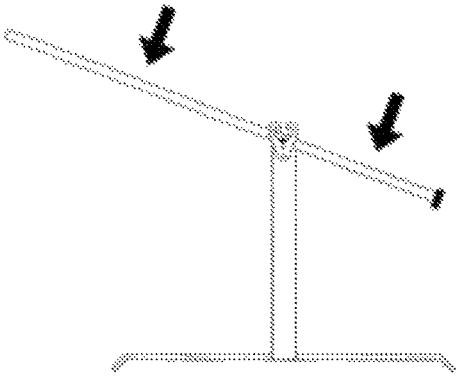
FIG. 46 shows a side view of the sign under wind effect, according to an exemplary embodiment of the invention.
Figure 47:
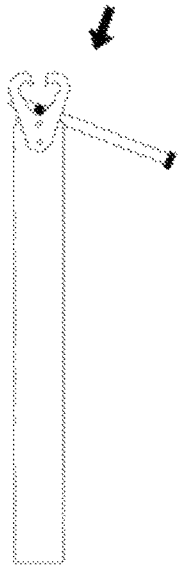
FIG. 47 shows a side view of a portion of the sign under wind effect, according to an exemplary embodiment of the invention.
Figure 48:
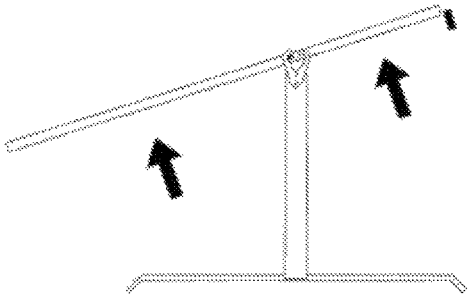
FIG. 48 shows a side view of the sign under wind effect, according to an exemplary embodiment of the invention.
Figure 49:
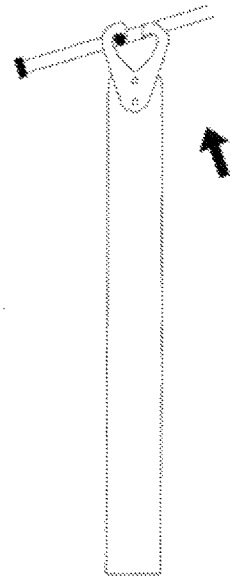
FIG. 49 shows a side view of the sign under wind effect, according to an exemplary embodiment of the invention.
Figure 50:
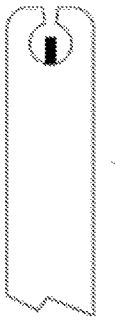
FIG. 50 shows a side view of an exemplary non-circular pin (in this case a rectangular one), according to an exemplary embodiment of the invention.
Figure 51:
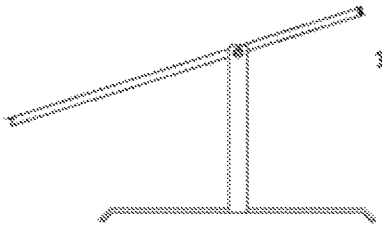
FIG. 51 shows a side view of an exemplary non-circular pin (in this case a rectangular one) with the sign under wind effects, according to an exemplary embodiment of the invention.
Figure 52:
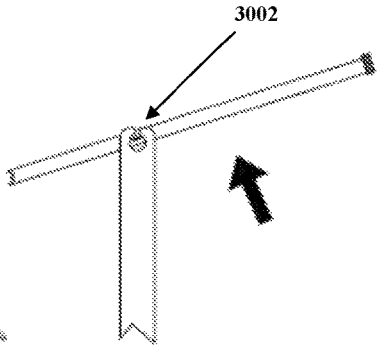
FIG. 52 shows a side view of an exemplary non-circular pin (in this case a rectangular one) with the sign under wind effects, according to an exemplary embodiment of the invention.
Figures 53, 54, 55, 56, 57:
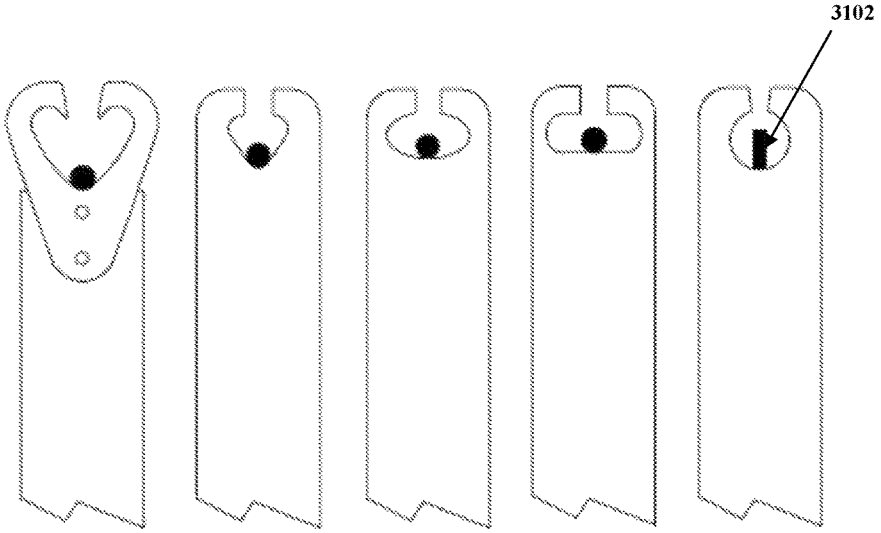
FIG. 53 shows a side view of a pin within a pin cavity, according to an exemplary embodiment of the invention.
FIG. 54 shows a side view of a pin within a pin cavity, according to an exemplary embodiment of the invention.
FIG. 55 shows a side view of a pin within a pin cavity, according to an exemplary embodiment of the invention.
FIG. 56 shows a side view of a pin within a pin cavity, according to an exemplary embodiment of the invention.
FIG. 57 shows a side view of a pin within a pin cavity, according to an exemplary embodiment of the invention.

The shape of the pin cradle is critical 108, particularly the top. As seen in FIG. 2, the opening at its top 112 is best shaped so that when the display panel 114 swivels within the frame (in response to the wind, user input or other forces), the pin 116, 118 will not 'escape' the pin cradle cavity 202 through the top opening 112. This is best accomplished by having the pin cradle cavity 202 have an opening at the top 112 which is just wide enough to allow for the pin 116, 118, 402 rod width easy entry into the cradle. The space or cradle cavity 202 below this opening 112 may be wider and deeper that the diameter of said pin, with the width of said cradle cavity 202 being sufficient so as to capture the pin within a side pocket to each side of the cradle. Of course, a user can remove the display panel simply by pulling the display panel up so as the pins lift up through the cradle opening 112.

The shape of the pin cradle is critical. As seen in FIG. 2, the opening at its top 202 is best shaped so that when the display panel swivels within the frame (in response to the wind, the pin 116 will not 'escape'. This is best accomplished by having the pin cradle have an opening just wide enough to allow the pin entry into the cradle, the space below this opening is wider and deeper than the smallest dimension of said pin, the space's width being sufficient to capture the pin in a pocket to either side of the cradle. Of course, a user can remove the display panel simply pulling the sign up so the pins lift up through the cradle opening.

In one embodiment the top of the inside of the cradle opening has one or more of the pin cradle gap edges equipped with a pin trapping outcrop, flange, overhang, projection or protrusion 1502 formed along at least one side of said gap edges. In this fashion when the wind pushes the sign, and forces the pin to 'ride up' along one of the sides of the cradle opening, the pin is trapped by the protrusion.

The shape of the opening 112 top is best shaped so that when the sign pins 116, 118, 402 moves and swivels within the display panel support frame (in response to the wind/people/other hitting/rocking it), the pin 116, 118, 402 will not 'escape' the cradle cavity 202. This is best accomplished by having the pin holder/cavity sides 204, 206 have an aggressive entry into the opening or gap 112, so that the pin has a tough path to follow when trying to escape the pin support or pin cavity 202 area. Of course, when a user desires to remove the sign, simply pulling the sign up so the pins go through the gap 112 opening, is sufficient.

As wind pressure occurs on the display panel 114, it forces the pin 116, 118, 402 to move against one side of the pin cradle 202 resulting on an 'up' movement against the pin cradle 202 wall. Here is where the shape of the elements forming the 'inside' of the opening 112 gap having an overhang 204, 206 come into play. In one embodiment 210, the gap wall overhang 204, 206 forms a parallel walled opening 112, whose cradle cavity 202 is wider at the top than at its bottom, or vice-versa. In another 212, the opening 112 gap 204, 206 forms a progressively narrower opening as it moves into the cradle 202, forming a natural gap into which the pin 116, 118, 402 nestles, with the cradle cavity having a hook shape to keep the pins 'snared' within the cavity. In another embodiment 214, the gap opening 112 wall's overhang 204, 206 progressively narrower opening goes into a circumferential/ellipsoid pin cradle 202 shape. Similarly, the gap walls 218 may be parallel, and the cradle shape elliptical/racetrack shaped. Notice other combinations of the above may be well understood to also be possible and herein disclosed.

In an alternative embodiment, the display panel support frame 300 may be comprised of two individual assemblies 302, 304. Each assembly has half of the pin cradle area 202, 1200, forming a pin cradle area similar to the ones explained above 210-214, 1200. These assemblies may close completely to form a vertical member 700. The 'closed' frame assembly, may be a single side, in which case two or more vertical members 700 are required (one per side of the display panel 114), or it may (when closed) form a 'U' (FIG. 1, 106) spanning the display panel 114 with cradle areas 202, 1200 at each end. Alternatively, each pair 302, 304 and/or 902, 904 is long enough to form an A-frame 900, where the legs open and complementary legs 902, 904 have tops that form the pin cradles 202, 1200. One such pair per side is enough to support the display panel 114. Another embodiment would include not using legs 104, and instead simply sticking the display panel support frame 106, 700 into a pin or other support mounted into the ground.

In an alternate embodiment, the display panel support frame on one side would have a pin cradle area 202 as shown 210-214, with the cradle area 1200 on the other side being a closed opening (of any suitable shape, complementary or not to that chosen for the first side, including square, etc.). To insert the sign, the user would first insert the pin into the close area 1200, then simply 'drop' the other pin into the gap 112.

FIGS. 4-8 illustrate the effects of the wind 602 on the display. The wind 602, pushes the larger area of the sign (in this case the top) down 604, resulting in a moment of inertia transfer (through the pin's 116, 118, 402) force on the cradle 202 to transfer down the display panel support frame 106 (or leg assemblies 302, 304) to the ground 606 on the side opposite the wind. This causes the pin to 'ride up' the pin cradle 202 wall, but since the force is opposite to the cradle 202 wall, said wall's overhang 204, 206 provides a contour against which the pin forces are unable to 'climb out', trapping the pin 106, 108, 402 within the pin cradle 202. In effect, 'lifting' the pins off said cradle, require a vertical force, which if only provided by an uplift that is coordinated with the pins being centered on the cradle, that is, the force a human brings when carefully removing the sign.

The pins going into each gap may be equally sized, or differentially sized, as long as the pin slides easily through the cradle opening gap. As such, the pins may be of equal or lesser size than the gap they intend to go into, allowing for some flexibility in the cradle material.

CONCLUSION

In concluding the detailed description, it should be noted that it would be obvious to those skilled in the art that many variations and modifications can be made to the preferred embodiment without substantially departing from the principles of the present invention. Also, such variations and modifications are intended to be included herein within the scope of the present invention as set forth in the appended claims. Further, in the claims hereafter, the structures, materials, acts and equivalents of all means or step-plus function elements are intended to include any structure, materials or acts for performing their cited functions.

It should be emphasized that the above-described embodiments of the present invention, particularly any "preferred embodiments" are merely possible examples of the implementations, merely set forth for a clear understanding of the principles of the invention. Any variations and modifications may be made to the above-described embodiments of the invention without departing substantially from the spirit of the principles of the invention. All such modifications and variations are intended to be included herein within the scope of the disclosure and present invention and protected by the following claims.

The present invention has been described in sufficient detail with a certain degree of particularity. The utilities thereof are appreciated by those skilled in the art. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the forgoing description of embodiments.

The invention claimed is:

1. A portable sign apparatus comprising:

two or more pin cradles;

one or more display panel support frame(s), each said support frame having one or more said pin cradles placed on the end of said support frame;

a display panel assembly;

a pin assembly comprised of one or more rods whose ends form pins that extend from said display panel assembly, wherein each said pin end goes through a pin cradle opening; and wherein one or more of said pin cradle openings has a gap formed along the top, said gap having a span equal or larger than the diameter of the pin going into said pin cradle, one or more of said pin cradle gap edges have a hook pin trapping protrusion formed along at least one side of said gap edge and wherein said gap remains uncovered and unblocked during said portable sign operation.

2. The apparatus of claim 1 wherein;

said pin assembly is comprised of one or more pins extending from two or more sides of said display panel assembly.

3. The apparatus of claim 2 wherein;

said display panel assembly is comprised of a display panel.

4. The apparatus of claim 3 wherein;

said display panel has a weight at or near said panel's bottom; and said display panel support frames are supported by one or more legs.

5. The apparatus of claim 3 wherein;

said display panel has a weight at or near said panel's bottom; and said display panel support frames are supported by one or more legs.

6. The apparatus of claim 2 wherein;

said display panel assembly is comprised of a sign frame.

7. The apparatus of claim 6 wherein;

said display panel has a weight at or near said panel's bottom; and said display panel support frames are supported by one or more legs.

8. The apparatus of claim 6 wherein;

said sign frame has a weight at or near said frame's bottom; and said display panel support frames are supported by one or more legs.

9. The apparatus of claim 1 wherein;

said pin assembly is comprised of a single rod across said display panel assembly.

10. The apparatus of claim 9 wherein;

said pin assembly is comprised of one or more pins extending from two or more sides of said display panel assembly.

11. The apparatus of claim 10 wherein;

said display panel assembly is comprised of a display panel.

12. The apparatus of claim 11 wherein;

wherein one or more of said pin cradle gap edges have a pin trapping protrusion formed along at least one side of said gap edge.

13. The apparatus of claim 12 wherein;

said display panel has a weight at or near said panel's bottom; and said display panel support frames are supported by one or more legs.

14. The apparatus of claim 11 wherein;

said display panel has a weight at or near said panel's bottom; and said display panel support frames are supported by one or more legs.

15. The apparatus of claim 9 wherein;

said display panel assembly is comprised of a sign frame.

16. The apparatus of claim 15 wherein;

wherein one or more of said pin cradle gap edges have a pin trapping protrusion formed along at least one side of said gap edge.

17. The apparatus of claim 16 wherein;

said display panel has a weight at or near said panel's bottom; and said display panel support frames are supported by one or more legs.

* * * * *